US005312221A

United States Patent [19]

Furukawa et al.

[11] Patent Number: 5,312,221

[45] Date of Patent: May 17, 1994

[54] PILE BOARD INSERTING METHOD AND A PILE BOARD INSERTING MACHINE FOR CARRYING OUT THE SAME

[75] Inventors: Shigeo Furukawa, Chiba; Hiromitsu Numauchi, Toride, both of Japan

[73] Assignee: Komori Corporation, Tokyo, Japan

[21] Appl. No.: 25,888

[22] Filed: Mar. 3, 1993

Related U.S. Application Data

[62] Division of Ser. No. 686,181, Apr. 16, 1991, Pat. No. 5,240,370.

[30] Foreign Application Priority Data

Jun. 1, 1990 [JP] Japan ..... 2-141587
Jun. 7, 1990 [JP] Japan ..... 2-147444

[51] Int. Cl.[5] ..... B65G 59/02

[52] U.S. Cl. ..... 414/786; 414/796.8; 414/331; 414/222; 414/273; 101/37

[58] Field of Search ..... 414/786, 788.4, 788.1, 414/788.8, 789.7, 789.9, 790.3, 790.4, 790.8, 794.7, 331, 796, 796.7, 796.8, 222, 749, 750, 273; 101/11, 37, 40, 1, 287, 297; 271/3, 269, 271

[56] References Cited

U.S. PATENT DOCUMENTS

| | | | |
|---|---|---|---|
| 3,381,830 | 5/1968 | Vasse | 414/790.4 |
| 3,722,713 | 3/1973 | Garabedian et al. | 414/796.8 |
| 3,770,143 | 11/1973 | Breitbach | 414/788.8 |
| 3,869,049 | 3/1975 | Selusnik et al. | 414/796.8 |
| 3,907,274 | 9/1975 | D'Amato et al. | 271/218 X |

FOREIGN PATENT DOCUMENTS

| | | | |
|---|---|---|---|
| 741645 | 8/1966 | Canada | 414/796.8 |
| 1002364 | 7/1957 | Fed. Rep. of Germany . | |
| 1288985 | 2/1969 | Fed. Rep. of Germany | 414/796.7 |
| 218062 | 1/1985 | Japan | 414/796.7 |
| 71025 | 3/1988 | Japan | 414/794.7 |
| 101272 | 5/1988 | Japan . | |
| 123761 | 5/1988 | Japan . | |

*Primary Examiner*—Frank E. Werner
*Attorney, Agent, or Firm*—Abelman Frayne & Schwab

[57] ABSTRACT

A pile board inserting machine comprises two pile board inserting units installed in combination respectively with the two sheet piling units of a sheet-fed printing press. Printed sheet are delivered alternately to the two pile board inserting units every time a predetermined number of printed sheets are delivered to each sheet piling unit, and the pile board inserting unit associated with the inoperative sheet piling unit is operated to insert a pile board while the sheet piling unit is at rest. Each pile board inserting unit comprises a lifting bar for lifting stacked pile boards, a pile board inserting mechanism for pushing the top pile board into the sheet piling unit, a lower limit detecting switch for detecting the arrival of the lifting bard at a lowermost position, an automatic start switch which starts lifting bar raising operation only when the lower limit detecting switch is closed, warning devices which provides an alarm upon the reduction of the number of pile boards on the lifting bars to a predetermined number, and stopping devices for stopping the printing press after the duration of the alarm has exceeded a predetermined time. The pile board is inserted automatically into the sheet piling unit, and the operator is warned of the reduction of the pile board on the lifting bars by the alarm.

2 Claims, 7 Drawing Sheets

PILE BOARD INSERTING METHOD AND A PILE BOARD INSERTING MACHINE FOR CARRYING OUT THE SAME

This application is a division of U.S. patent application Ser. No. 07/686/181 filed Apr. 16, 1991, now U.S. Pat. No. 5,240,370.

BACKGROUND OF THE INVENTION

1. Field of the Invention

The present invention relates to a method of inserting a pile board into the sheet piling unit of the sheet delivery unit of a sheet-fed printing press, and a pile board inserting machine for carrying out the same.

2. Description of the Prior Art

A pile delivery operation is performed during the printing operation of a sheet-fed printing press to remove printed sheets piled on a pile board from the delivery unit of the printing press without stopping the printing operation, or, to remove a pile of a predetermined number of printed sheets from the delivery unit of the printing press without stopping the printing operation.

A pile board is lowered automatically as printed sheets are delivered successfully onto the pile board. Upon the delivery of the last printed sheet of a predetermined number of printed sheets onto the pile board, the pile board loaded with the printed sheets is lowered by a small distance, and then another pile board is inserted into the sheet piling unit above the pile of the printed sheets on the loaded pile board. The number of When the printing press is provided with a single sheet piling unit, a new pile board must be inserted quickly into the sheet piling unit in synchronism with the operation of the printing press which then is operating at a high printing speed, and which requires skilled work.

The frequency of pile board insertion increases with an increase in the printing speed of the printing press, thus increasing physical and mental load on the operator. Furthermore, if a pile board inserted unsuccessfully into the sheet piling unit, the printed sheet may be damaged.

Therefore, the printing speed of the printing press is reduced during the insertion of a pile board onto the delivery path, or, the printing press is operated continuously at a comparatively low printing speed when sheets of a large lot are to be printed, and frequent pile board insertion is necessary.

SUMMARY OF THE INVENTION

Accordingly, it is an object of the present invention to provide a method of automatically inserting a pile board into the sheet delivery path of a sheet delivery unit.

Another part of the present invention is to provide a pile board inserting machine capable of automatically inserting a pile board into the sheet delivery path of a sheet delivery unit.

In one aspect of the present invention, a pile board inserting machine comprises a plurality of pile board inserting units which are installed in combination, respectively, with a plurality of sheet piling units of a printing press.

The pile board inserting units each comprise:

lifting bars supported for vertical movement on frames:

support brackets provided on the lifting bars and capable of supporting stacked pile boards when the lifting bars move upward, and, of removing the pile boards when the lifting bars move downward;

pile board inserting means provided on the frames to push a pile board toward the associated sheet piling unit, to insert the top pile board of the boards supported on the support brackets upon the arrival of the lifting bar at a position where the top pile board is located at a pile board inserting position;

lower limit detecting means for detecting the arrival of the lifting bars at a position Where the support brackets have escaped the bottom pile board among those stacked at a stacking position;

an automatic start switch for starting a lifting bar raising operation only while the lower limit detecting means is active;

pile board depletion Warning means which provides an alarm upon the reduction of the number of pile boards remaining on the support brackets to a predetermined number; and, stopping means for stopping the printing press after the duration of the alarm has exceeded a predetermined time.

In another aspect of the present invention, a pile board inserting method to be carried out by a pile board inserting machine comprising two pile board inserting units installed in combination respectively with the sheet piling units of a sheet-fed printing press, the sheet-fed printing press being capable of selectively delivering printed sheets either to one of the two sheet piling units, or to the other sheet piling unit, by controlling a sheet releasing means provided on the respective sheet piling units comprising: synchronously operating the sheet releasing means and the pile board inserting units; and operating the pile board inserting unit to insert a pile board into the associated sheet piling unit to which printed sheets are not being delivered.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENT

Figure 1:
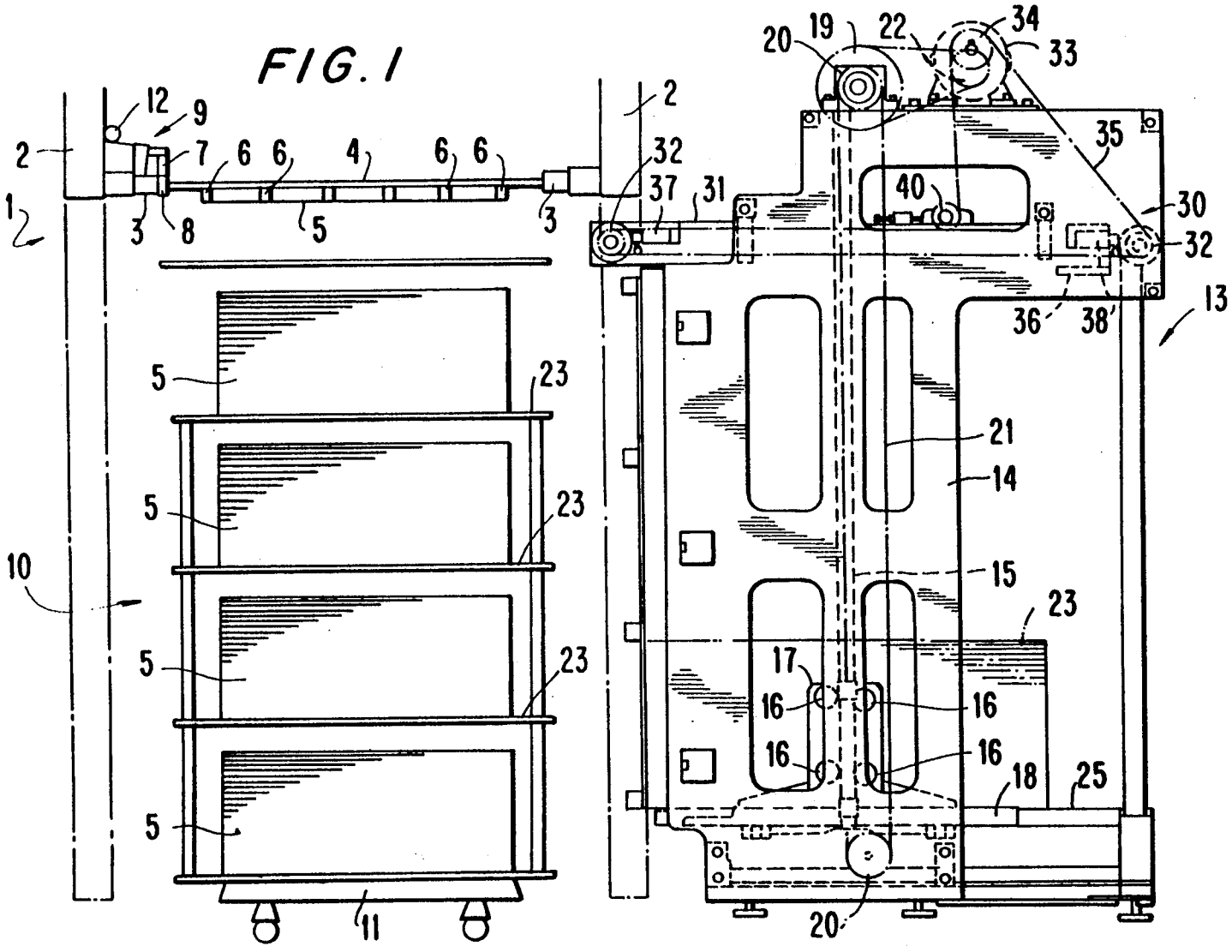
FIG. 1 is a front view of a sheet delivery unit provided with two sheet piling units, and a pile board inserting machine consisting of two pile board inserting units, in a preferred embodiment according to the present invention.
Figure 2:
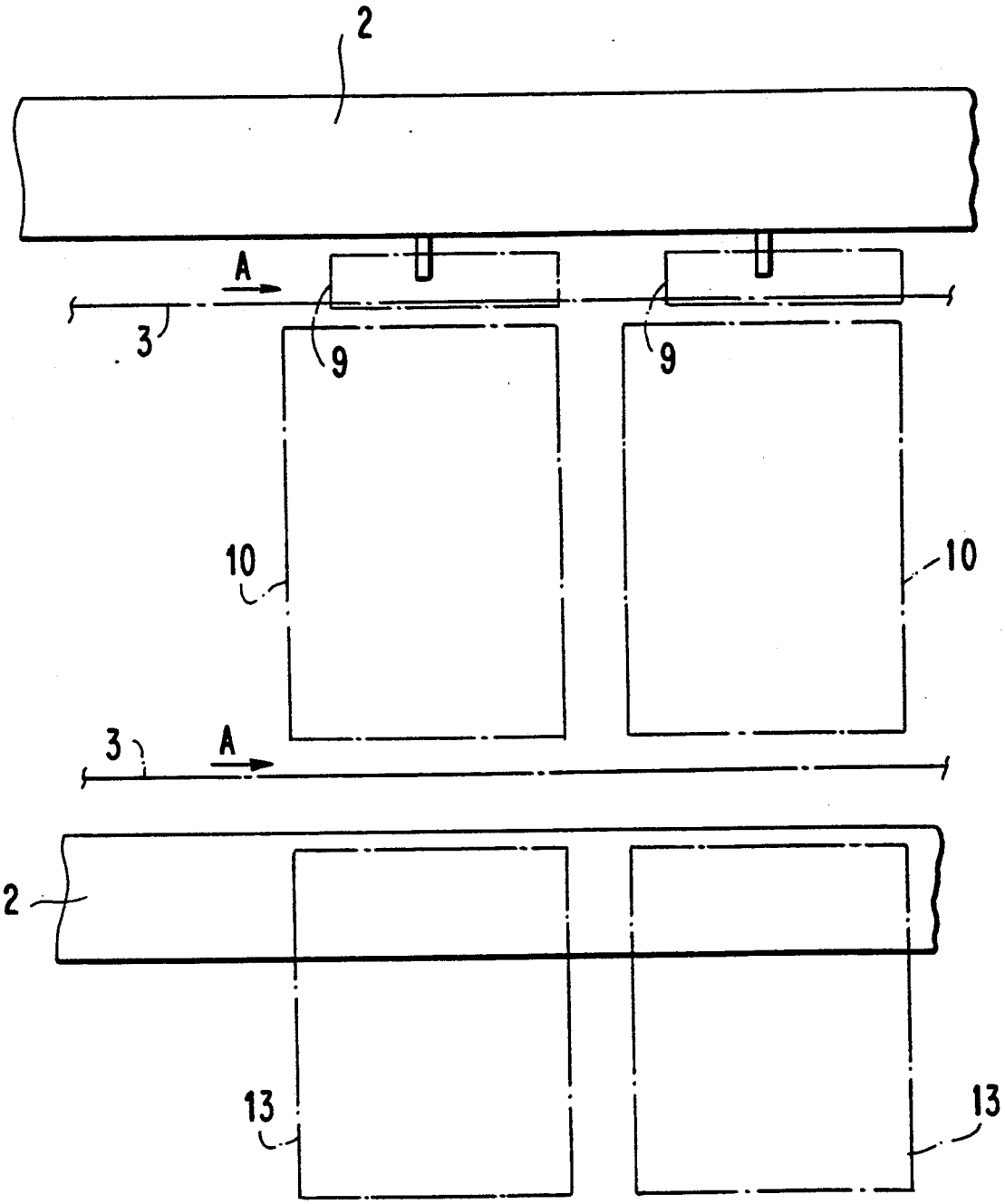
FIG. 2 is a schematic plan view of the sheet delivery unit of FIG. 1.

Referring to FIGS. 1 and 2, a sheet delivery unit 1 of a printing press is provided with two sheet piling units 10 and a pile board inserting machine consisting of two pile board inserting units 13 installed in combination respectively with the sheet piling units 10. A pair of delivery chains 3 extend respectively along the side frames 2 of the sheet delivery unit 1, so as to move in the direction of an arrow A (FIG. 2). A plurality of gripper rods 4 are extended between the pair of delivery units 3. Each gripping rod 4 is provided with a plurality of gripers 6 for gripping a sheet 5 and a cam follower 7. When the cam follower 7 engages a cam 8 of a sheet releasing device 9, the grippers 6 release the sheet 5. The two sheet piling units 10 are arranged one after the other along a sheet delivery direction. Each sheet piling unit 10 is provided with a pile truck 11, which is raised automatically. The sheet releasing devices 9 are mounted on the side frame a respectively near the sheet piling units 10. Each sheet releasing device 9 is provided with an actuator 12 for changing the phase of the cam 8 relative to the cam follower 7 to control the gripping action of the grippers 6. The actuators 12 change the phases of the cams 8 of the corresponding sheet releasing devices 9 so that sheets 5 are delivered to one or the other of the two sheet piling units 10.

Figure 3:
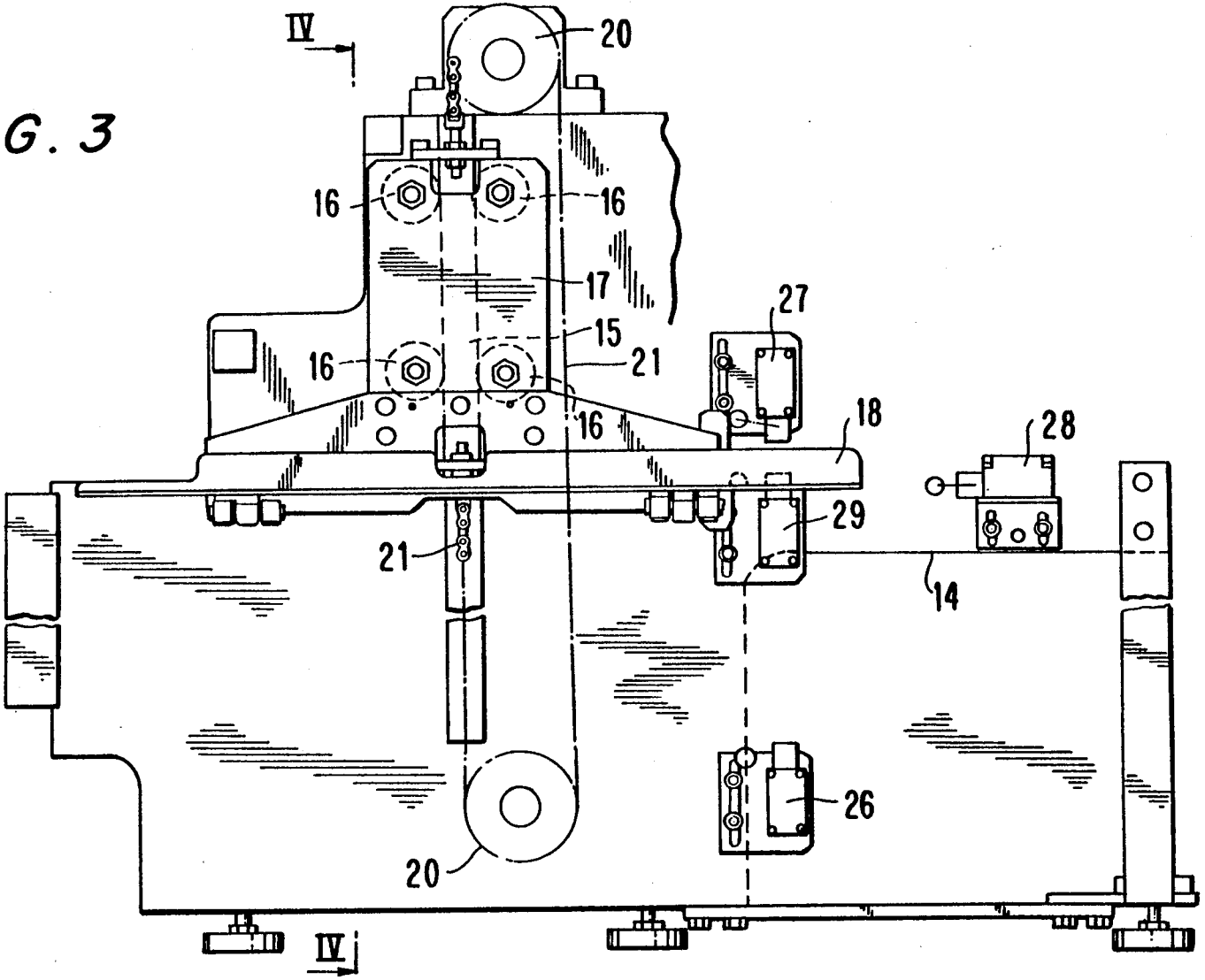
FIG. 3 is a front view of the pile board inserting unit shown in FIG. 1, in a state where a lifting bar is raised.
Figure 4:
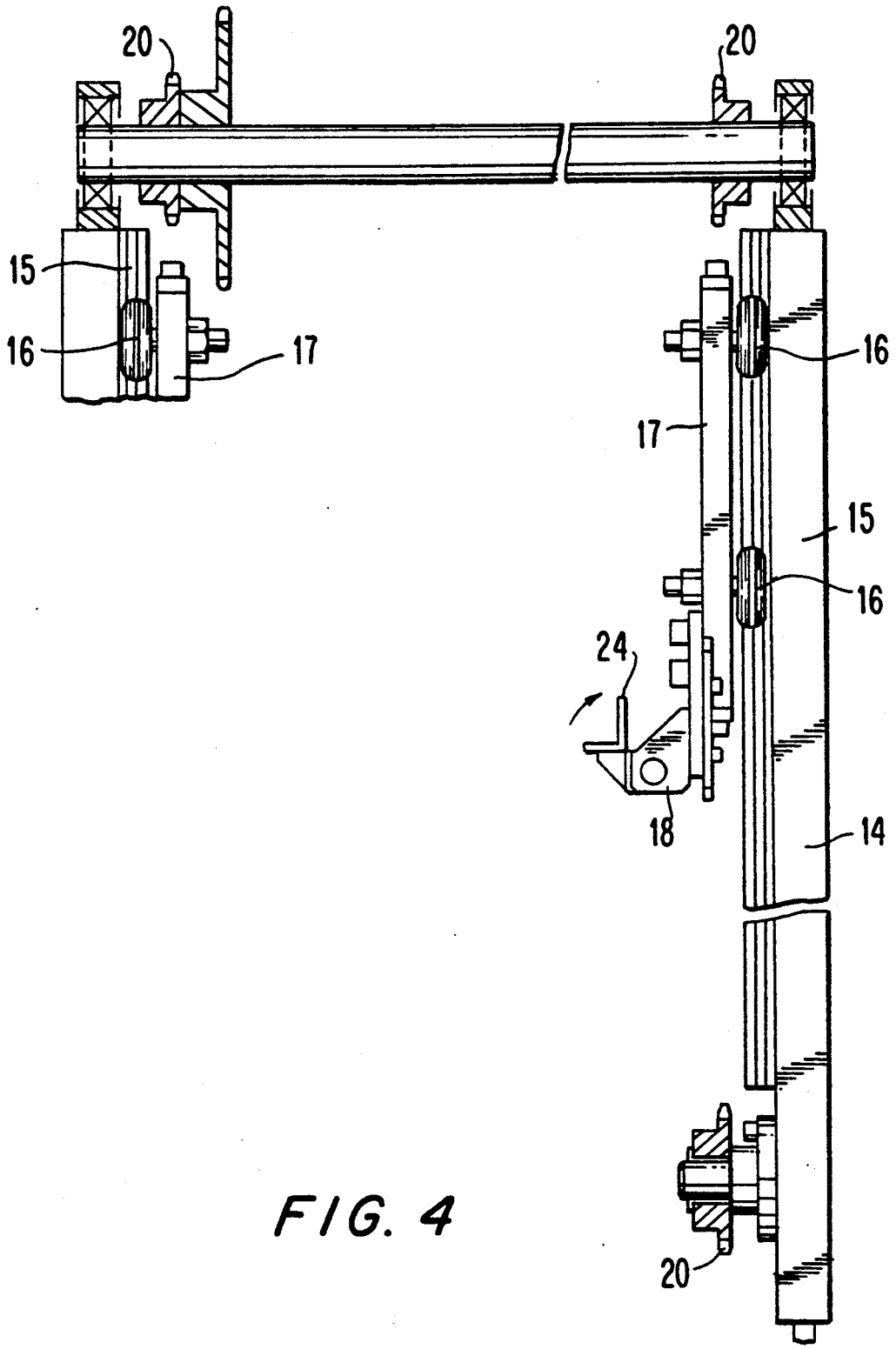
FIG. 4 is a sectional view taken on line IV—IV in FIG. 3.

The two pile board inserting units 123 feed pile boards respectively onto the pile trucks 11 of the sheet piling units Referring to FIGS. 3 and 4, vertical guide rails 15 are fixed to the side frames 14 of the pile board inserting unit 13. Lifting plates 17 are provided with guide rollers 16, which roll along the corresponding guide rails 15 as the lifting plates 17 move vertically. Lifting bars 18 are fixed to the respective lower sides of the lifting plates 17 for movement together with the lifting plates 17 and extend horizontally to the running direction of the sheets 5.

A pair of sprockets 20 ar supported on each side frame 14 respectively at an upper position and a lower position, and a chain 21 is wound around the sprockets 20. The chain 21 has one end connected to upper end of the lifting plate 17 and the other end connected to the lower end of the lifting plate 17. A motor 22 (FIG. 1) supported on the side frame 14 drives the sprocket 20 for rotation through a driving sprocket 29 to move the lifting plates 17 vertically together with the lifting bars 18. The lifting bars 18 are raised when the motor 22 rotates in the normal direction, and are lowered when the motor 22 rotates in the reverse direction.

As shown in FIG. 4, the lifting bars 18 are provided With support brackets 24 to support stacked piling boards 23. The support brackets 24 project horizontally to support the pile boards 23. Each support bracket 24 is capable of turning only in one direction from its horizontal position on the corresponding lifting bar to escape the pile boards 23 stacked at a storage position as the lifting bar 18 moves downward relative to the pile boards 23. Guides 25 (FIG. 1) guide a hand lift truck, not shown, in carrying a plurality of stacked pile board 23 by the handlift truck into the space between the side frames 14 of the pile board inserting unit 13.

As shown in FIG. 3, a lower limit detecting switch 26, i.e., lower limit detecting means, is attached to a lower portion of the side frame 14 to detect the arrival of the lifting bar 18 at a position below the bottom pile board 23 among those stacked at the storage position. Attached to an upper portion of the side frame are an upper limiting detecting switch 27 for detecting the arrival of the lifting bar 28 at its uppermost position; a top pile board detecting switch 28 for detecting the arrival of the top pile board 23 among those stacked on the lifting bars 18 at a pile board inserting position; and, a pile board depletion warning switch 29 for providing am alarm upon the depletion of the pile boards 23 on the lifting bars 18 to a predetermined number of pile boards, for example, thee pile boards 23.

A pile board inserting mechanism 30 provided on the frames 14 is operative to insert the top pile board 23 located at the pile board inserting position into the sheet delivery unit 1, as will be described hereinafter with reference to FIGS. 5 to 7.

Figure 5:
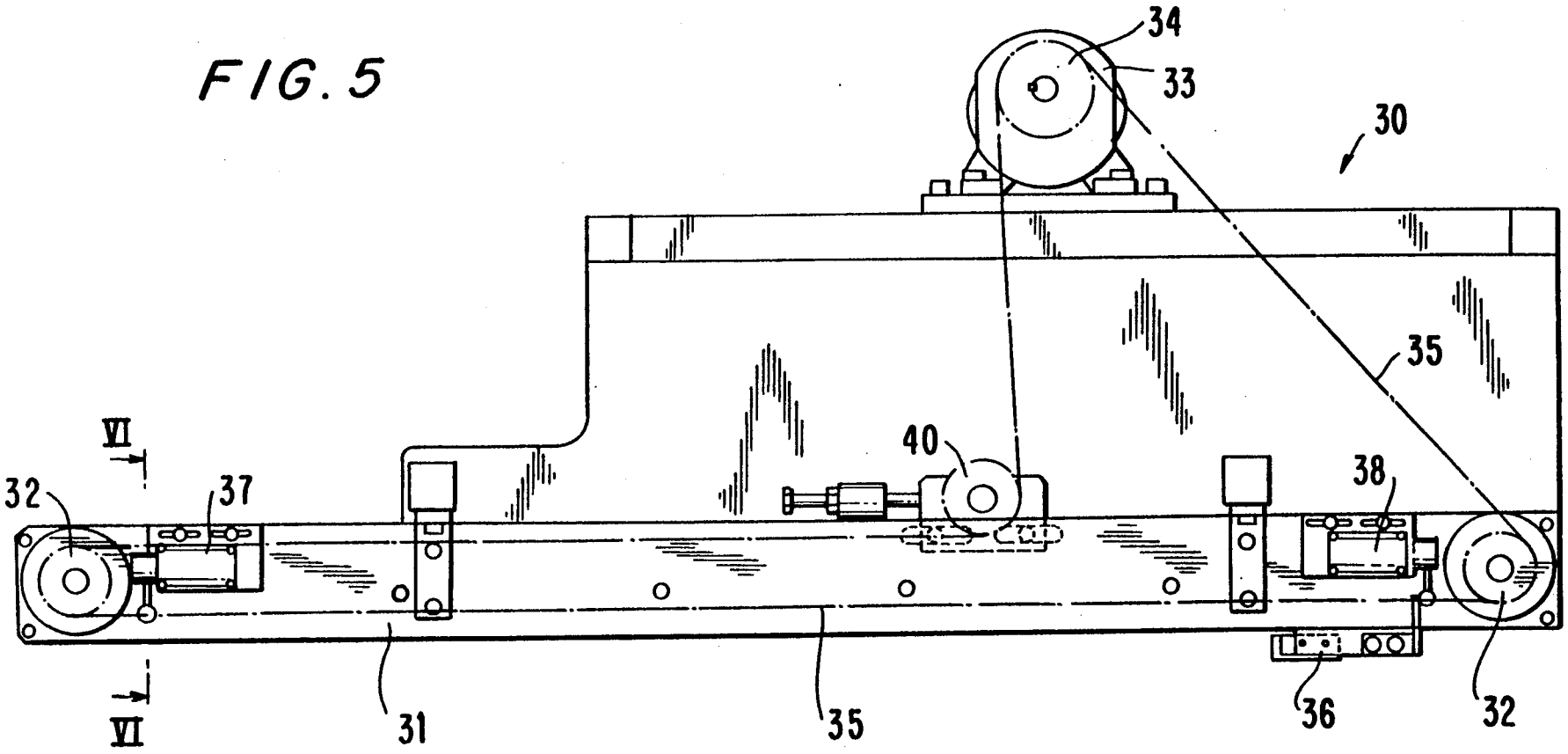
FIG. 5 is a front view of a pile board inserting mechanism.

As shown in FIG. 5, second frames 31 are joined respectively to the upper sides of the side frames 14 so as to extend in parallel to the lifting bars 18. A pair of sprockets 32 are supported on each second frame 31 respectively at the opposite ends of the lower portion of the same. A motor 33 is mounted on top of the second frame 31. A chain 35 is wound around a driving sprocket 34 mounted on the output shaft of the motor 33, and around the sprockets 32, and, the chain 35 is tightened by a tension sprocket 40.

Figure 6:
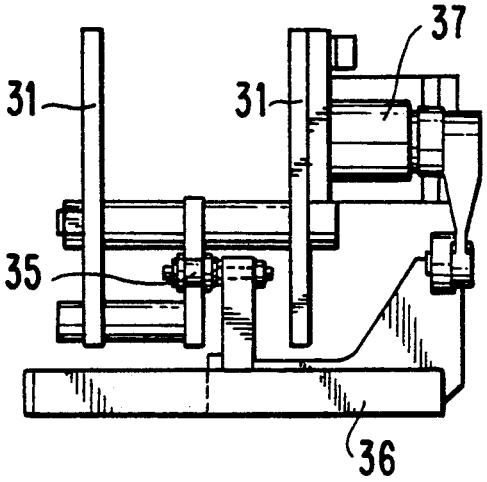
FIG. 6 is a sectional view taken on line VI—VI in FIG. 5.
Figure 7:
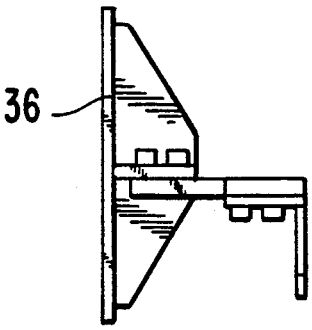
FIG. 7 is a view taken on line VII—VII in FIG. 5.

As shown in FIGS. 6 and 7, push plates 36 are fixed to the chains 35. The motor 33 is driven alternately for rotation in the normal direction and in the reverse direction to reciprocate the push plates 36 along the second frames 31. A front limit position detecting switch 37 is provided near the front end of the second frame 31, namely one end of the second frame 31 on the side of the sheet delivery unit 1, to detect the arrival of the push plates 36 at a frontmost position, and a rear limit detecting switch 38 is provided near the rear end of the second frame 31, namely, the other end of the second frame 31 far from the sheet delivery unit 1, to detect the arrival of the push plates 36 a rearmost position. This push plates 36 push the pile board 23 located at the pile board inserting position into the associated sheet piling unit 10 of the sheet delivery unit 1 during their forward stroke.

Figure 8:
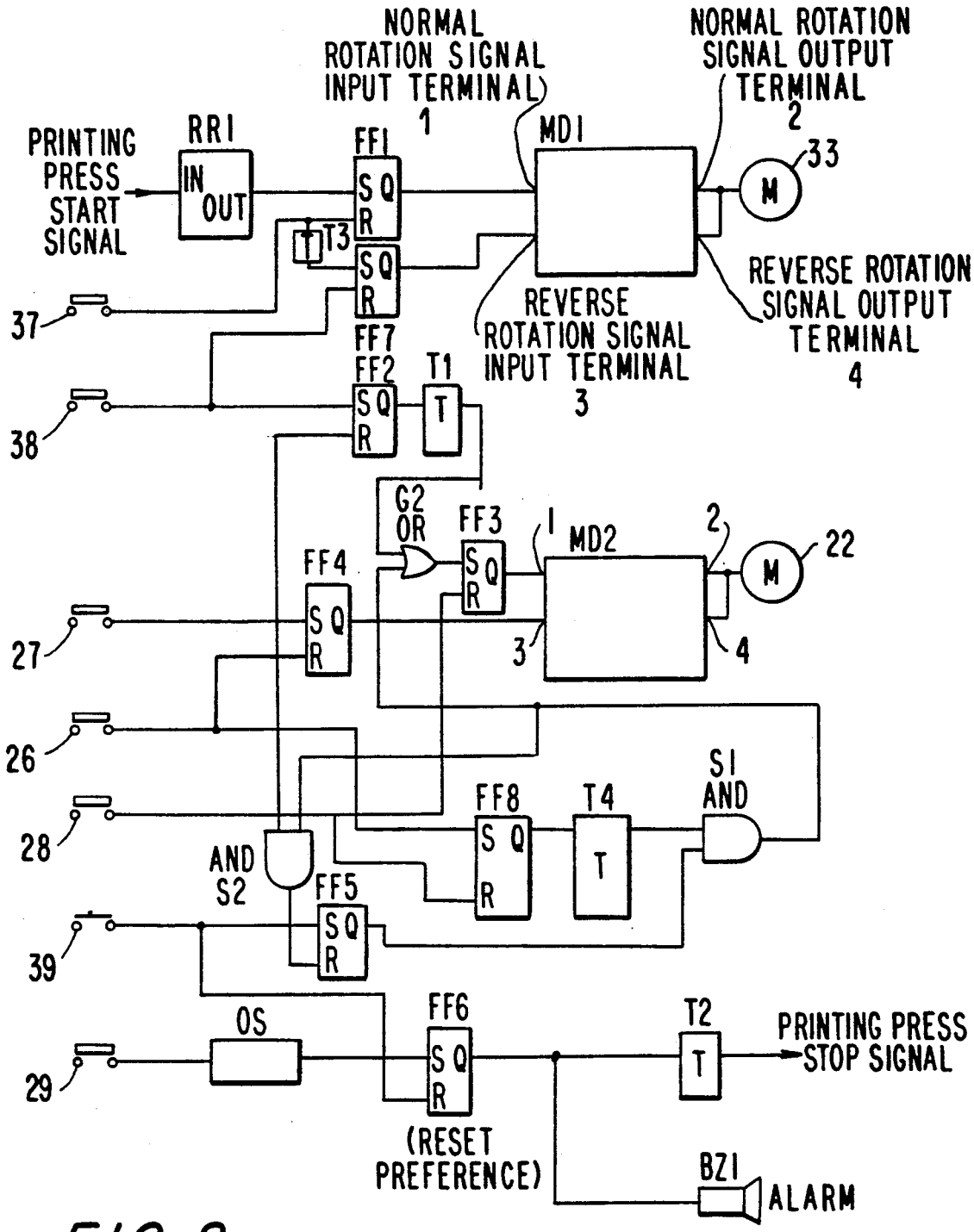
FIG. 8 is a block diagram of a controller included in the pile board inserting machine.

The operation of the pile board inserting mechanism will be described with reference to FIG. 8. The two sheet piling units 10 operate alternately in the same manner, and hence only the operation of one of the sheet piling unit 10 and that of the associated pile board inserting unit 13 will be described.

A pile board 23 is placed on the pile truck 11, the lifting bars 18 are lowered to the lowermost position, a plurality of pile boards 23 are stacked on the support brackets 24 of the lifting bar 18, a sheet counter RR1 is set for a predetermined number, for example, 500, and then the printing press is started. Every time the count of the sheet counter RR1 provides a signal to actuate the actuators 12 of the sheet releasing device 9 to change the phases of the cams 8 so that the predetermined number of printed sheets are delivered alternately to the two sheet piling units 10. Since the two pile boards inserting units 13 operate in the same manner, the operation of only one of them will be described hereinafter.

In a state where the lifting bars 18 are at the lowermost position, the push plates 36 are at the rearmost position, and the lower limit detecting switch 26 and the rear limit detecting switch 38 are closed, a signal HIGH is applied to the rest terminal R of a flip-flop FF4 to reset the flip-flop FF4, and a signal HIGH is applied to the set terminal S of a flip-flop FF8 to set the flip-flop FF8, so that a signal HIGH is applied to a timer T4 connected to the terminal Q of the flip-flop FF8 to start the timer T4. At the end of a predetermined time interval for which the timer T4 is set, the timer T4 applies a signal HIGH to an AND gate S1. Since the rear limit detecting switch 38 is closed, a signal HIGH is applied to the reset terminal R of a flip-flop FF7 to reset the flip-flop FF7, and a signal HIGH is applied to the set terminal S of a flip-flop FF2 to set the flip-flop FF2 to apply a signal HIGH to a timer T1 connected to the terminal Q of the flip-flop FF2 to start the timer T1. At the end of a predetermined time interval for which the timer T1 is set, the timer T1 applies a signal HIGH to an OR gate G2 to set a flip-flop FF3 by applying a signal HIGH to the set terminal S of the flip-flop FF3, so that the terminal Q of the flip-flop FF3 goes HIGH. Consequently, the normal operation signal input terminal of a motor controlled MD2 goes HIGH to drive the motor 22 for rotation in the normal direction to raise the lifting bars 18.

Upon the arrival of the lifting bars 18 at the uppermost position corresponding to the pile board inserting position, the top pile board detecting switch 28 is closed, and thereby the flip-flop FF3 is reset to stop the motor 22. Thus, upon the arrival of the top pile board inserting position, the upward movement of the lifting bars 18 is stopped to keep the top pile board 23 standing by at the pile board inserting position.

Upon the coincidence of the count of the sheet counter RR1 with the predetermined number, printed sheets are delivered to the other sheet piling unit 10. Then, a signal HIGH is applied to the set terminal S of a flip-flop FFI, so that the flip-flop FF1 is set and the terminal Q of the flip-flop goes HIGH to apply a signal HIGH to the normal rotation signal input terminal of a motor controlled MD1. Consequently, the motor 33 is driven for rotation in the normal direction to advance the push plates 36 by the chain 35 to insert the pile board 23 into the sheet piling unit 10. Then, the pile truck 11 of the sheet piling unit 10 is raised slightly to locate the pile board 23 at an appropriate sheet receiving position. Upon completion of inserting the pile board 23 into the sheet piling unit 10, the front limit position detecting switch 37 is closed to apply a signal HIGH to the reset terminal R of the flip-flop FF1 and thereby a timer T3 is started. When the flip-flop FF1 is reset, the normal rotation signal input terminal of the motor controller MD1 goes LOW to stop the motor 33. At the end of a preset time interval for which the timer T3 is set, the timer T3 applies a signal HIGH to the set terminal S of a flip-flop FF7 to set the flip-flop FF7. Then, an output signal HIGH of the flip-flop FF7 is applied to the reverse rotation signal input terminal of the motor controller MDI to drive the motor 33 for rotation in the reverse direction to move the push plates 36 backwards. Upon the arrival of the push plates 36 at the rearmost position, the rear limit detecting switch 38 is closed and a signal HIGH is applied to the reset terminal R of the flip-flop FF7 to reset the flip-flop FF7. Consequently, the reverse rotation signal input terminal of the motor controller MD1 goes LOW to stop the motor 33.

At the same time, the flip-flop FF2, the timer T1, the OR gate G2 and the flip-flop FF3 function to apply a signal HIGH to the normal rotation signal input terminal of the motor controller MD2 to drive the motor 22 again for rotation in the normal direction to raise the lifting bars 18. Every time the arrival of the top pile board 23 at the pile board inserting position, the operation for inserting the pile board 23 and the operation for raising the lifting bars 18 are performed to insert the pile board 23 automatically into the sheet piling unit 10. During the insertion of the pile board 23 into the sheet piling unit 10, printed sheets are delivered continuously to the other sheet piling unit 10.

When the number of the pile boards 23 remaining on the lifting bars 18 has decreased to a predetermined number after the repetition of the operation for inserting the pile board 23 into the sheet piling unit 10 and the operation for raising the lifting bars 18, the pile board depletion warning switch 29 is closed to trigger a one-shot circuit OS so that the OS circuit applies a single pulse to the set terminal S of a flip-flop FF6 to set the flip-flop FF6. Then, the terminal Q of the flip-flop FF6 goes HIGH to request the operator to prepare a stack of pile boards 23 by actuating a buzzer BZ1. Then, the operator places a new stack of pile boards 23 under the lifting bars 18 and pushes the push button of an automatic pile board supply switch 39 to close the same. Then, a signal HIGH is applied to the reset terminal R of the flip-flop FF6 to reset the flip-flop FF6. Since the flip-flop FF6 is of a reset preference type, the terminal Q of the flip-flop FF6 goes LOW and hence the buzzer BZ1 stops. The output signal of the flip-flop FF6 is applied also to a timer T2 to start the same. The flip-flop FF6 and the timer T2 serve as printing press stopping means. If a new stack of pile boards 23 is not supplied to the pile board inserting unit 13, namely, if the automatic pile board supply switch 39 is not closed, in a predetermined time interval (several minutes) for which the timer T2 is set after the flip-flop FF6 has been set, the timer T2 provides a stop signal to stop the printing press.

Upon the arrival of the lifting bards at the uppermost position after the insertion of the last pile board 23 into the sheet piling unit 10, the upper limit detecting switch 27 is closed. Then, the set terminal S of the flip-flop FF4 goes HIGH, the terminal Q of the flip-flop FF4 goes HIGH, the terminal Q of the flip-flop FF4 goes HIGH, the reverse operation signal input terminal of the motor controller MD2 goes HIGH and, consequently, the motor 22 is driven for rotation in the reverse direction to lower the lifting bars while the printing operation is continued, and the printed sheet delivered to the sheet piling units 10 ar removed from the sheet piling units 10 without interrupting the printing operation.

Since the pile board inserting machine supplies a plurality of pile board 23 automatically when the push button of the automatic pile board supply switch is operated, inserts the pile board 23 automatically and successively into the sheet piling unit 10, and gives an alarm signal upon the decrease of the number of the pile boards 23 to a predetermined number, the operator is above to engage in other tasks including inspecting and monitoring the printing press without paying attention to the number of residual pile boards. The printing press is stopped to obviate troubles if the pile boards 23 are not supplied to the pile board inserting unit 13 in a predetermined time interval after the alarm has been given.

The pile board inserting unit 13 is able to insert the top pile board 23 among the stacked pile boards 23 automatically by the push plates 36 by a comparatively small driving force without entailing interference between the stacked pile boards 23, so that the life of the pile boards is extended.

According to the foregoing pile board inserting method in accordance with the present invention, printed sheets are delivered alternately to the two sheet piling units 10 and the pile board 23 is inserted automatically to one of the sheet piling units 10 to which printed sheets are not delivered while the printed sheets are delivered to the other sheet piling unit 10 to deliver printed sheets continuously without reducing the printing speed of the printing press for pile board insertion. Furthermore, since the pile board 23 is inserted into the sheet piling unit 10- while printed sheets are delivered to the other sheet piling unit 10, printed sheets are not damages by the pile board 23. Thus, the present invention reduces load on the operator prevents the production of spoiled printed sheets and eliminates impediments to the enhancement of the printing speed.

What is claimed is:

1. A pile board inserting method comprising series of steps of:

lifting pile boards supported on support brackets capable of supporting pile boards during their upward movement and of escaping pile boards during their downward movement by raising lifting bars holding the support brackets to locate a top pile board among those supported on the support brackets at a pile board inserting position;

inserting the top pile board located at the pile board inserting position into a sheet piling unit of a printing press by pile board inserting means;

generating an alarm by pile board depletion warning means upon a decrease of a number of the pile board supported on the support brackets to a predetermined number during a operation for successively locating the pile boards supported on the support brackets at the pile board inserting position by raising the lifting bars;

stopping the printing press by stopping means if a duration of the alarm exceeds a predetermined time;

continuing the upward movement of the lifting bars if a stack of pile boards is placed at a storage position and the alarm is stopped by an operator before an elapse of the predetermined time after the generation of the alarm;

lowering the lifting bars after the bottom pile board has been inserted into the sheet piling unit and the arrival of the lifting bars at the uppermost position has been detected by upper limit position detecting means;

detecting an arrival of the lifting bars at a lowermost position by lower limit position detecting means after the support brackets have escaped the bottom pile board among those stacked at the storage position;

raising the lifting bars after the lower limit position detecting means has detected the arrival of the lifting bars at the lowermost position and an automatic start switch has been operated, to locate the pile boards supported on the support brackets successively at the pile inserting position; and sequentially repeating the foregoing steps.

2. A pile board inserting method according to claim 1, wherein the alarm generated by said pile board depletion warning means is stopped by operating said automatic start switch.

* * * * *